United States Patent [19]

Wencley

[11] Patent Number: 4,914,883

[45] **Date of Patent: * Apr. 10, 1990**

[54] METHOD OF BONDING STRUCTURAL SUPPORT CHANNELS TO A PANEL

[75] Inventor: Stanley E. Wencley, Rochester, Mich.

[73] Assignee: Foamseal, Inc., Oxford, Mich.

[ * ] Notice: The portion of the term of this patent subsequent to Jun. 7, 2005 has been disclaimed.

[21] Appl. No.: 172,683

[22] Filed: Mar. 24, 1988

Related U.S. Application Data

[63] Continuation of Ser. No. 921,443, Oct. 22, 1986, Pat. No. 4,748,781.

[51] Int. Cl.[4] ..... E04C 1/00

[52] U.S. Cl. ..... 52/309.5; 52/827; 52/732; 156/79; 264/46.4

[58] Field of Search ..... 52/309.5, 309.11, 827, 52/601, 734, 732, 347, 352, 309.7, 309.8, 821; 156/79, 91; 428/139; 264/46.4, 46.5, 263; 29/469, 460

[56] References Cited

U.S. PATENT DOCUMENTS

| | | | |
|---|---|---|---|
| 3,258,889 | 7/1967 | Butcher | 52/309.11 |
| 3,300,931 | 1/1967 | Lütze | 52/309.5 |
| 3,333,390 | 8/1967 | Banning | 52/732 |
| 4,244,901 | 1/1981 | Wencley et al. | 52/309.11 X |
| 4,289,554 | 9/1981 | Reicherts et al. | 52/309.5 X |
| 4,748,781 | 6/1988 | Wencley | 52/309.5 |

*Primary Examiner*—Carl D. Friedman

*Attorney, Agent, or Firm*—Dykema Gossett

[57] ABSTRACT

A method of bonding rigid structural support members to a gypsum or fiberboard panel to form a structural building module. The method involves applying a polyurethane adhesive as a liquid by high pressure stream into a space formed at the junction of the support members and the panel. The space is established by providing a plurality of spaced feet on one planar side of the support members. The support members includes either integrally formed feet, which are placed on the panel, or non-integral feet that are inserted between the support members and the panels. The support members may include holes on the surface bonded to the panel in a face to face relationship or on vertical surfaces in close proximity to the panel through which foam may expand and form a mechanical interlock with the support members. The support members may be metal channels or wood members. The structural building module provides an increased strength bonded structure without the use of nails or other fasteners. The film also provides a thermal insulating layer between the structural support members and the panels.

15 Claims, 2 Drawing Sheets

METHOD OF BONDING STRUCTURAL SUPPORT CHANNELS TO A PANEL

CROSS-REFERENCE TO RELATED APPLICATION

This is a continuation of application Ser. No. 06/921,443, filed Oct. 22, 1986, now U.S. Pat. No. 4,748,781, issued June 7, 1988.

BACKGROUND OF THE INVENTION

I. Technical Field

This invention relates to construction of prefabricated building modules and more particularly to bonding structural reinforcement members to flexible panels.

II. Brief Description of the Background Art

In the manufacture of prefabricated homes or mobile homes, it is preferred to bond wooden trusses or studs to flexible gypsum or fiberboard panels with a polyurethane foam adhesive, according to the technique dislcosed in my prior U.S. Pat. No. 4,244,901. When wood supports are laid upon the flat surface of the gypsum or fiberboard substrate, gaps are formed between the wood and the substrate. Polyurethane foam adhesive flows into and expands in the gaps formed between the structural member and the substrate. The bond between the structural member and the panel provides good support for the panel without mechanical fasteners, and provides a flat, continuous surface which compensates for and actually benefits from any inherent warpage in the structural support members.

Metal support members currently being considered for use in building modules are generally formed with substantially smooth and flat walls that fit flush against the substrate. Metal support members are non-porous and may have lower adhesion than wood support members or the panels to polyurethane foam adhesives. Minimal gaps are formed between the support and the substrate into which the liquid polyurethane resin can flow and expand. When a stream of liquid polyurethane thermosetting resin is directed at an angle under pressure at the juncture between the structural elements and the panel, the resin forms a fillet, or convexly curved section, at the angle formed by the junction of the panel and the support member. Stresses tending to separate the panel from the support member are primarily resisted by the shear strength of the adhesive bond to the perpendicular surface of the support member. With wooden support members, separation is resisted by both the tensile strength of the urethane as it is bonded to opposed facing surfaces of the panel and the support member and the shear strength of the adhesive bond to the perpendicular surface of the support member.

Another problem presented by the use of metal support members is that the thermal conductivity of the metal support members results in the transfer of heat energy. With wooden support members, the inherent insulative properties of wood reduce the transfer of heat through the support members. Structural panels are generally insulated between support members, but heat can be transferred through the support members if they are formed of metal.

It is an object of the present invention to improve the adherence of rigid metal or wooden support members to a substrate such as gypsum wall board or fiber board.

Another object of the present invention is to establish a predetermined space between support members and substrates which may be filled with a liquid polyurethane resin wherein forces tending to separate the support members from the substrates are opposed by the tensile strength of the polyurethane resin bond. Also, by filling the space, the surface area available for bonding between the resin, support members and panel is increased.

A further object of the present invention is to establish a thermal break between substrates and metal support members, such as steel and aluminum support members.

In addition to the increased surface area for bonding and reliance upon tensile strength of the polyurethane resin, it is an object to further improve the bonding between the substrate and support member by providing a mechanical interlock of polyurethane resin and the support members. Portions of the support members include holes or are specially formed to create the mechanical interlock when the polyurethane resin expands through and bonds to the specially-formed portions.

SUMMARY OF THE INVENTION

This invention provides a method of forming a structural building element by bonding flexible substrate panels, such as a gypsum wall board, fiberboard or the like to rigid structural support channels. The method comprises forming or locating spacers on the planar side of structural support channels which are intended to be bonded to the panel. Next, the panel is placed on a support surface and the support members are placed upon the side of the panel facing away from the support surface with the spacers located between the support members and the panel. The spacers establish a substantially uniform space at the juncture between the planar side of the channel and the panel. A stream of liquid polyurethane thermosetting resin is then directed under pressure into the space. The liquid polyurethane stream is directed into the space at the juncture between the structural elements and the panel to form a substantially continuous interlayer at the juncture, permanently bonding the structural elements to the panel and forming a rigid structural building element.

The channel used to form the support may have a C-shaped, I-shaped, U-shaped or rectangular cross-section. The step of forming the spacers, or feet, in metal channels preferably includes punching a plurality of tongues or tabs in one planar surface of the channel. The tongues or tabs are formed by partially severing sections from said one planar surface and bending the sections outwardly. The step of forming the feet may include bending at least part of a lateral or longitudinal edge of the channel surface to extend at an angle relative to the planar surface.

In a preferred embodiment of the present invention, the feet are displaced from the planar surface to form an opening in the planar surface. The resin may then flow through the opening and expand to establish a mechanical interlock between the foam and the support member.

The foam, after curing, provides a uniform layer of insulative polyurethane resin between the support member and the panel corresponding to the uniform space established by the spacers. The insulative properties of the polyurethane resin eliminate the disadvantages previously associated with the use of metal support members in prefabricated building construction relating to the high thermal conductivity of metal supports.

The feet are preferably formed in the support member by punching a tab, flange or other upstanding member from a roll-formed channel section that may be either I, U or C-shaped. In addition to providing tabs or flanges in the support member, a mechanical interlock may be achieved by punching holes completely through the surface of the support member in an area intended to be contacted by the foam. The polyurethane foam expands through the holes in the support member to create the mechanical interlock.

The method of the present invention preferably incorporates the use of a liquid polyurethane thermosetting resin which expands and cures. However, the polyurethane thermosetting resin may be of a non-foaming type applied in a high pressure liquid stream. Expanding polyurethane resin is preferable due to its ability to fill voids and thereby assure bonding effectiveness even though some variance in application technique may occur. Non-expanding polyurethane adhesives may be used in certain applications where additional density is preferred.

These and other advantages of the present invention will become more readily apparent after reading the following written description of several embodiments of the present invention in conjunction with the appended claims and the attached drawings.

DETAILED DESCRIPTION

Figure 1:
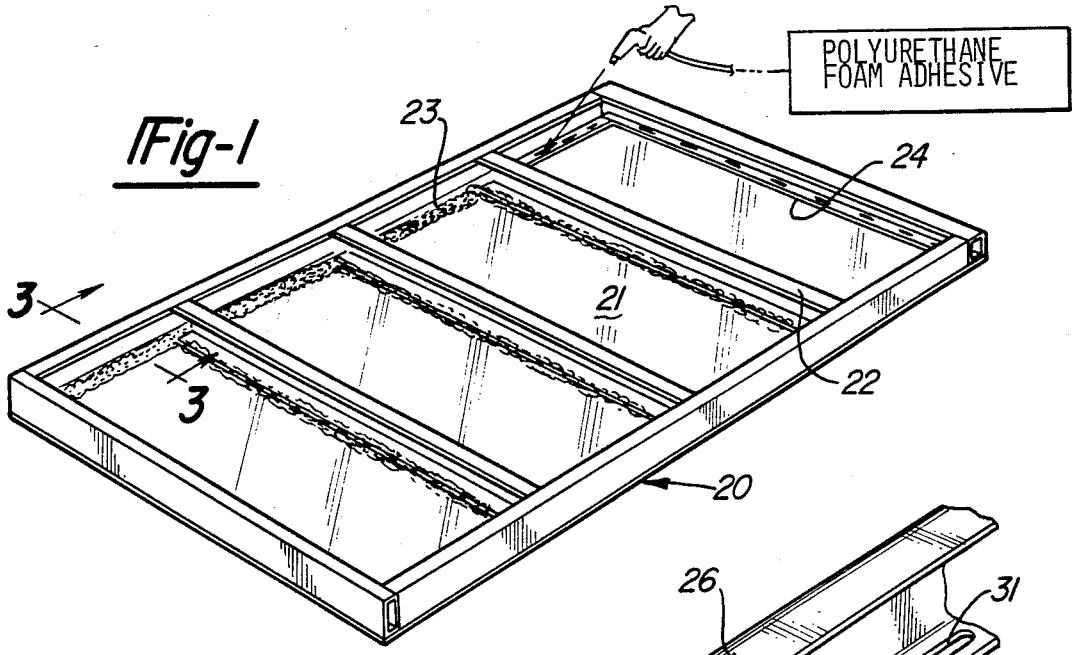
FIG. 1 is a schematic perspective drawing of the method of bonding support members to a panel by liquid stream application of an adhesive filler material.

Referring now to the drawings, FIG. 1 illustrates a structural building module 20 made according to the method of the present invention wherein a gypsum drywall or fiberboard panel 21, or substrate, is joined to a plurality of channels 22 by applying a liquid stream of urethane adhesive 23. The urethane adhesive 23 is applied at the junction of the substrate 21 and the channel 22 in space 24.

Figure 2:
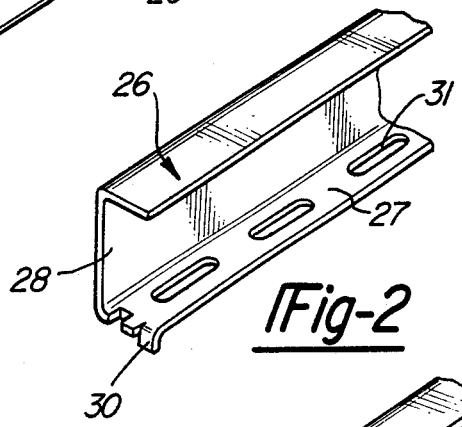
FIG. 2 is a perspective fragmentary view of a C-shaped channel having two tabs at one end and a series of holes cut in the planar surface of the channel to be attached to the panel.
Figure 3:
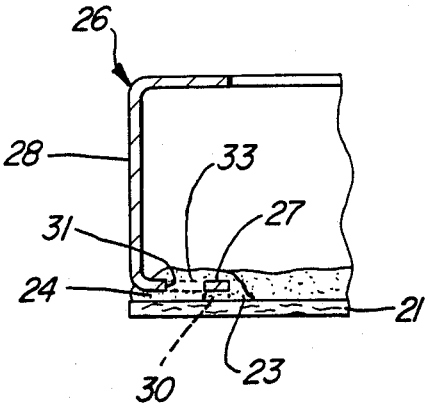
FIG. 3 is a cross-sectional view showing the channel of FIG. 2 after application of the polyurethane foam adhesive.

Referring now to FIGS. 2 and 3, the method of the present invention will be described as applied to a C-shaped channel 26 having a base wall 27 and a perpendicular sidewall 28. The first step of the present invention is to form a plurality of edge tabs 30, or feet, upon the base at one end of the C-shaped channel 26. The edge tabs 30 extend from the base 27 on the side of the base facing away from the sidewall 28. The substrate panel 21 is then placed on a supporting surface. The edge tabs 30 of the channel 26 are laid upon the substrate 21. The edge tabs 30 establish a substantially uniform space as a juncture between the channel and the substrate. A stream of liquid polyurethane thermosetting resin is then directed under pressure at a space formed at the juncture between the channels 22 and the substrate 21. The polyurethane resin flows into the space of the juncture between the channels and the panel and forms a substantially continuous layer at the juncture. The resin then bonds to the substrate and the channels to form a rigid structural building module.

The disclosure of my prior U.S. Pat. No. 4,244,901 is incorporated herein by reference for its disclosure of a suitable polyurethane foam and the processing description contained therein.

A mechanical interlock may be established by providing holes 31 which are punched through the base 27 of the C-shaped channel 26, as shown in FIGS. 2 and 3. The holes 31 provide a passageway for the foam 23 to flow through the space 24 and bond to the top surface of the base wall 27. When the foam flows through the holes 31, the expansion of the foam continues with the foam forming an expanded mass 33 shaped like a mushroom cap above the hole 31. The foam forms a mechanical interlock between the channel 22 and the foam 23 when the foam 23 hardens. The foam also forms a fillet 34 comprising a convexly-curved accumulation of foam at the juncture of the substrate 21 and the channel 22. The expanded mass 33 and fillet 34 may be separate or blend into one another.

Figure 4:
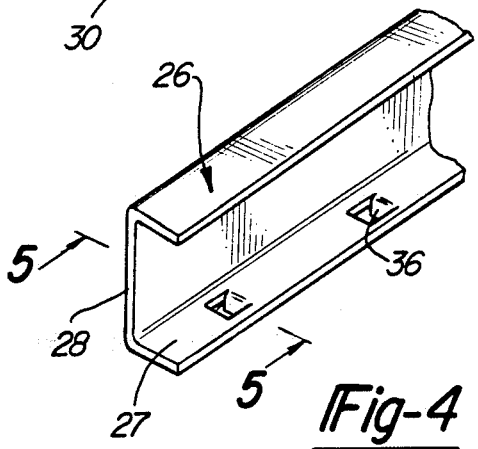
FIG. 4 is a perspective fragmentary view of a C-shaped channel having a series of tabs formed in the planar surface of the channel.
Figure 6:
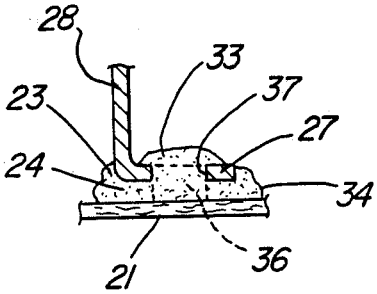
FIG. 6 is a fragmentary cross-sectional view of the channel shown in FIG. 4 after application of the polyurethane foam adhesive.
Figure 5:
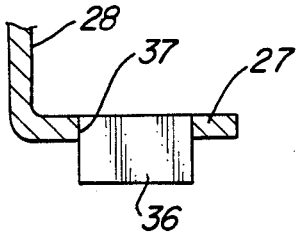
FIG. 5 is a fragmentary cross-sectional view taken along the line 5—5 in FIG. 4.

Referring now to FIGS. 4–6, an alternative method of forming a spacer integrally in a C-shaped channel 26 is illustrated. Instead of providing edge tabs 30, a plurality of medial tabs 36 can be formed in the base 27 of the C-shaped channel 26. The medial tabs 36 are formed by punching a small section of the base 27 outwardly from the C-shaped channel 26, forming a three-sided opening 37 in the base 27 and causing the medial tab 36 to extend substantially perpendicularly to the base 27 on the opposite side of the base from the sidewall 28. The foam 23 is applied as previously described and forms an expanded mass 33 upon passage through the three-sided opening 37 on the upper side of the base 27, thereby forming a mechanical interlock. The medial tab 36 supports the channel on the substrate 21 and establishes the uniform space 34 prior to the application of the polyurethane foam 23.

Figure 7:
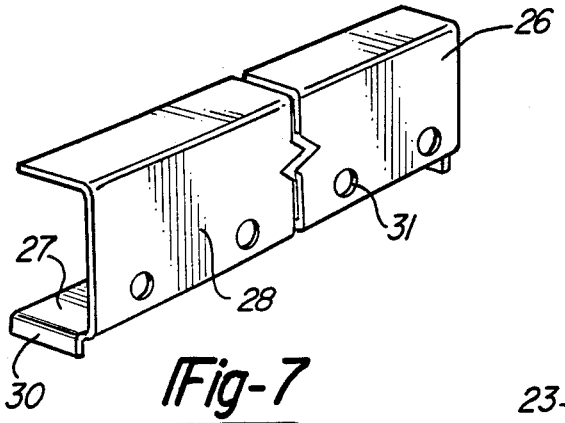
FIG. 7 is a perspective view of a channel having one end formed into a downwardly extending flange and having a plurality of openings formed in the upstanding wall of the C-shaped channel.
Figure 8:
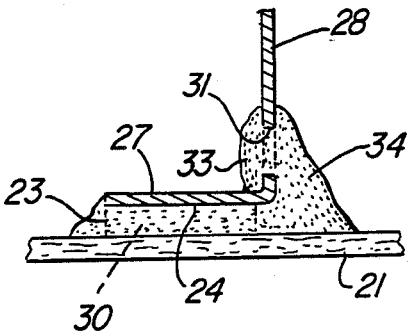
FIG. 8 is a fragmentary cross-sectional view of the channel shown in FIG. 7 after application of the polyurethane foam adhesive.

Referring now to FIGS. 7 and 8, an additional embodiment of a channel 22, made in accordance with the present invention, is shown to include a C-shaped channel 26 having a full-length edge tab 30 formed on opposite ends. The edge tabs 30 provide a uniform space 24 between the base 27 of the C-shaped channel 26 and the substrate 21 when placed on the substrate. Foam 23 can be directed into the uniform space 24 between the edge tabs 30 to bond to the channel 26 and the substrate 21. A fillet 34 is formed by the foam at the juncture and, as shown in FIG. 8, the foam may be permitted to flow through a series of punched holes 31 formed in the sidewall 28 of the C-shaped channel 26. The foam 23, after expansion through the holes 31, forms a mechanical interlock of the expanded mass 33 with the sidewall 28.

Figure 9:
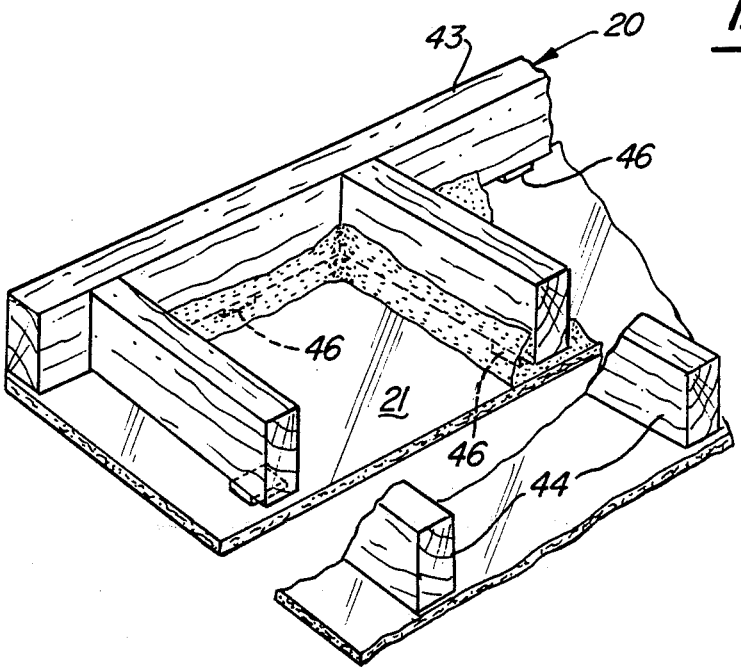
FIG. 9 is a fragmentary perspective view of wooden studs in the process of being secured to a flexible panel with a uniform space established between the flexible panel and the wooden studs by means of spacers.
Figure 10:
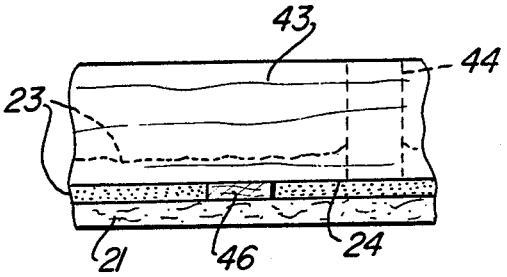
FIG. 10 is a fragmentary cross-sectional view taken along the line 10—10 in FIG. 9.

The concept of the present invention can be applied to wooden structural supports as illustrated in FIGS. 9 and 10. Plates 43 comprise top or bottom plates of a wall or ceiling frame having studs 44 which reinforce the structural building module 20 between the top and bottom plates 43. Spacers, comprising furring strips or other solid elements of suitable thickness, may be provided at predetermined intervals along the length of the plates 43 as shown or along the length of the studs 44. The spacers 46 provide a uniform space 24 between the substrate 21, plates 43 and studs 44.

In practicing the method of the present invention with wooden plates 43 and studs 44, the substrate 21 would be placed upon a supporting surface and the spacers would be either attached to the studs or plates when the studs or plates are assembled, or the spacers may be inserted under the plates 43 and studs 44 after they are laid upon the substrate 21. The polyurethane foam 23 may then be directed at the juncture between the plates 43, studs 44 and the substrate 21.

By providing the spacers 46, the increased bonding strength realized by providing face-to-face bonding surfaces between the substrate 21, plates 43 and studs 44 is assured. This eliminates the reliance upon an unpredictable degree of warpage in the wooden support members as was the case with my prior method. The preferred height of the spacers 46 may vary from one-sixteenth to one-quarter of an inch. The distance between spacers 46 is based upon the degree of bowing of the support members.

Holes could also be formed in the plates and studs to establish a mechanical interlock with the plates 43 and studs 44 in a manner similar to that shown in FIG. 7 for a C-shaped channel.

The foregoing is a complete description of several preferred embodiments of the invention. Various changes and modifications may be made without departing from the spirit and broad scope of the present invention. The invention should be limited only by the scope of the following claims.

What is claimed is:

1. A method of forming a prefabricated structurally reinforced building panel, including the following steps:

(a) laying the panel on a relatively flat surface;

(b) laying linear reinforcing members over one side of said panel;

(c) spacing said linear reinforcing members from said one side of said panel with small, individual spacer elements or a plurality of integral tabs punched out and displaced outwardly of one planar surface of the linear reinforcing member at predetermined intervals along the length of said linear reinforcing member to form a continuous space at the junction between said one planar surface and said panel;

(d) directing a continuous stream of a foamable liquid resin under high pressure into said space between said panel and said linear reinforcing members, forming a substantially continuous layer of foam between said panel and said linear reinforcing members; and (e) allowing said foamable liquid resin to fully set-up and permanently bond said linear reinforcing members to said panel in said spaced relation, thereby forming said prefabricated structurally reinforced building panel having a flat exposed surface.

2. The method of claim 1, wherein said reinforcing members are metal channels.

3. The method of claim 2, wherein the step of forming said integral tabs includes partially severing sections from said one planar surface and displacing said sections outwardly in a direction perpendicular to the plane of the planar surface to form a plurality of spaced feet.

4. The method of claim 3, wherein said step of forming said spaced feet includes bending at least part of an edge of said one planar surface to extend at an angle relative to said planar surface.

5. The method of claim 2, wherein a plurality of openings are formed through the metal channels in close proximity to the panel and said foam is a polyurethane thermosetting resin which flows through the openings and expands to form a mechanical interlock of the foam to the metal channels.

6. The method of claim 5, wherein said openings are formed in said one planar side of the metal channels.

7. The method of claim 5, wherein said openings are formed in a wall of the metal channels disposed perpendicular to said one planar side of the metal channels.

8. The method of claim 5, wherein said openings are formed in said one planar side of the metal channels by said step of forming the plurality of spaced feet.

9. The method of claim 2, wherein said metal channels are generally U-shaped and said method includes punching a plurality of spaced integral tabs through one side leg of said U-shaped metal channels and simultaneously forming openings through said one leg adjacent said tabs, and allowing said liquid resin to foam and expand through said openings onto the opposed surface of said leg, forming a mechanical interlock between said foam and said metal channels.

10. The method of claim 1, wherein said reinforcing members are wooden supports and said step of spacing said reinforcing members includes inserting small spacers between the wooden supports and the panel at required locations.

11. The method of claim 10, wherein said wooden supports include openings formed in the wooden supports to extend laterally through said wooden supports and parallel to the plane of the panel, and said foam flows into the openings and expands to form a mechanical interlock of the foam to the wooden supports.

12. A structural building module, comprising:

a flat self-supporting flexible panel having two surfaces;

a plurality of wooden supports positioned on one of the surfaces of the panel in a desired arrangement;

a plurality of small spacers situated between one planar side of said wooden supports and the surface of said panel forming a continuous space between the one planar side of said wooden supports and the surface of said panel; and a continuous layer of a polyurethane thermosetting resin forming a juncture between said wooden supports and said panel and permanently bonding said wooden supports to said panel, whereby the resin having been applied by directing a stream of liquid polyurethane thermosetting resin under pressure at the space between the wooden supports and the panel and allowing the liquid polyurethane thermosetting resin to flow into the space between the wooden supports and the panel to bond the wooden supports to the panel, thereby forming said structural building module having a flat exposed surface.

13. The structural building module of claim 12, wherein the wooden supports include openings formed therethrough into which the liquid resin flows and expands to form an expanded mass which mechanically interlocks the resin to the wooden supports.

14. The structural building module of claim 13, wherein the openings are formed in a side of the wooden supports facing the panel.

15. The method of claim 12, wherein said wooden supports include openings formed therein, which extend laterally through said wooden supports and parallel to the plane of the panel, and said foam flows into said openings and expands to form a mechanical interlock of the foam to the wooden supports.

* * * * *